US005154601A

United States Patent [19]

Lloveras Capilla

[11] Patent Number: 5,154,601

[45] Date of Patent: Oct. 13, 1992

[54] LIQUIFIED GAS KITCHEN LIGHTER

[75] Inventor: Francisco Xavier Lloveras Capilla, Montalt, Spain

[73] Assignee: Flamagas, S.A., Barcelona, Spain

[21] Appl. No.: 659,736

[22] Filed: Feb. 21, 1991

[30] Foreign Application Priority Data

Feb. 28, 1990 [IS] Iceland ..... 9000573

[51] Int. Cl.[5] ..... F23D 14/46

[52] U.S. Cl. ..... 431/255; 431/266; 431/344; 431/345

[58] Field of Search ..... 431/151, 144, 255, 258, 431/266, 264, 344, 345; 126/25 B

[56] References Cited

U.S. PATENT DOCUMENTS

| | | | |
|---|---|---|---|
| 3,580,698 | 5/1971 | Goto | 431/255 |
| 4,273,528 | 6/1981 | Gobelt | 431/255 |
| 4,292,021 | 9/1981 | Miyagawa | 431/13 |
| 4,403,946 | 9/1983 | Kagawa | 431/255 |
| 4,919,111 | 4/1990 | Ohsawa | 431/266 X |
| 4,920,952 | 5/1990 | Nakajima | 431/266 X |

FOREIGN PATENT DOCUMENTS

| | | |
|---|---|---|
| 0222336 | 5/1987 | European Pat. Off. . |
| 0259745 | 3/1988 | European Pat. Off. . |
| 2754639 | 1/1979 | Fed. Rep. of Germany . |
| 2156499 | 10/1985 | United Kingdom . |

*Primary Examiner*—Carl D. Price

*Attorney, Agent, or Firm*—Scully, Scott, Murphy & Presser

[57] ABSTRACT

A liquefied gas kitchen lighter in which the actuating means of the valve of the gas reservoir comprises a straight tubular member coaxial with straight container tube. The latter contains the piezo-electric generator and part of a burner, there being formed a generally straight route for the gas flow from the reservoir to the burner. The actuating means at the same time actuates the generator and provide the necessary electrical connections.

16 Claims, 2 Drawing Sheets

LIQUIFIED GAS KITCHEN LIGHTER

BACKGROUND OF THE INVENTION

1. Field of the Invention

The invention relates to a liquefied gas kitchen lighter comprising a gas reservoir with a gas exhaust chimney; a gas flow valve; actuating means for said valve moveable between a first closed position and a second open position; a resilient means urging said actuating means to said first position; an accessible push button fixedly attached to said actuating means; an impact piezoelectric generator having a front end adjacent the reservoir and a rear end opposite to said front end; a metal burner having an internal axial passage with an end outlet; a containter tube and an external metal shield.

2. Description of the Prior Art

In known lighters the electrical energy was transmitted from the piezoelectric generator to the electrodes adjacent the burner by insulated leads or shaped die-stamped metal strips, whereby the assembly of these lighters was cumbersome and could not be undertaken in an automatic assembly machine.

Up to date, the gas was transported from the metering valve, which is of necessity incorporated in the liquefied gas reservoir, to the burner by way of a feed tube, which must be plugged in at one end to the burner and at the other to the exhaust chimney. These again are cumbersome operations for automatic assembly machines. One example of an embodiment of the nature is described in EP-A-0 259 745 where insulated electric leads, die-stamped contact strips and supply tubes for the gas flow are to be seen.

Another known solution is disclosed in EP-A-0 222 336 wherein the feed tube is co-extruded with a conductor wire, so that the feed tube and one of the conductors to the electrodes is unified.

SUMMARY OF THE INVENTION

It is an object of this invention to provide a kitchen lighter wherein the abovementioned drawbacks are overcome, without requiring either the conductor leads to the electrodes or the feed tube from the exhaust chimney to the burner. At the same time there is achieved the advantage of reducing the number of components and simplifying the assembly operations, making automation thereof possible.

The above object is achieved with a lighter of the type first mentioned above, characterized in that said actuating means comprise a straight tubular member which is generally coaxial with said container tube, which is straight, contains said piezoelectric generator and partly contains said burner, with the interior of said tubular member, the interior of the container tube and the burner forming a flow passage of the gas from the exhaust chimney.

BRIEF DESCRIPTION OF THE DRAWING

Further advantages and features of the invention will be evident from the following description wherein without any limiting nature there is described a preferred embodiment of the invention with reference to the accompanying drawings in which.

DETAILED DESCRIPTION OF THE INVENTION

Figure 1:
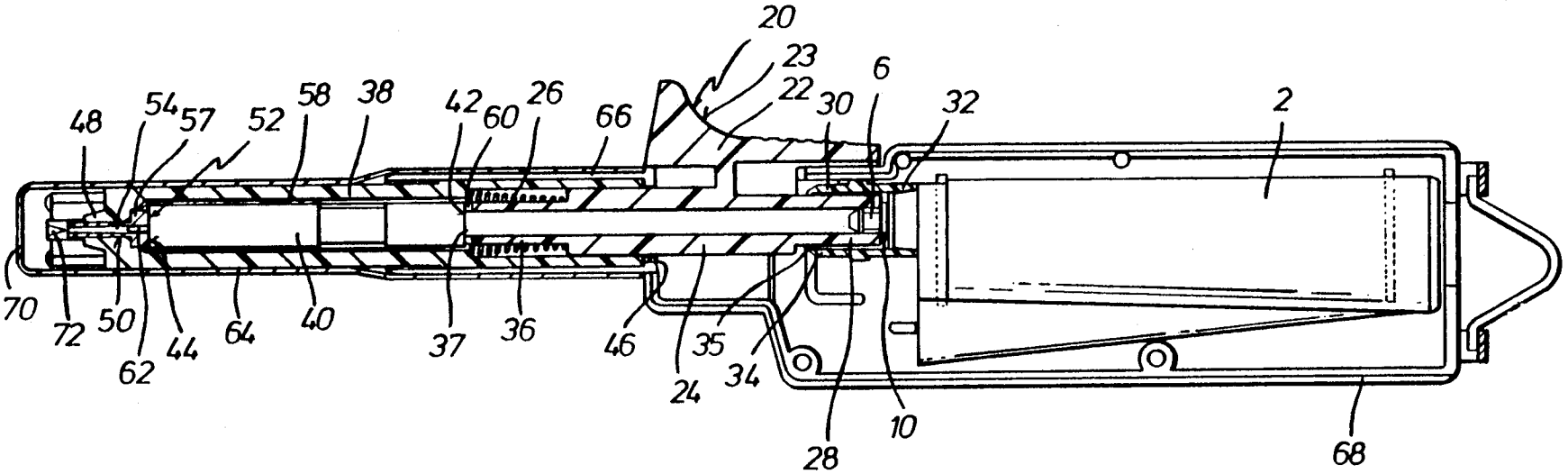
FIG. 1 is a longitudinal cross section of the kitchen lighter of the invention.
Figure 2:
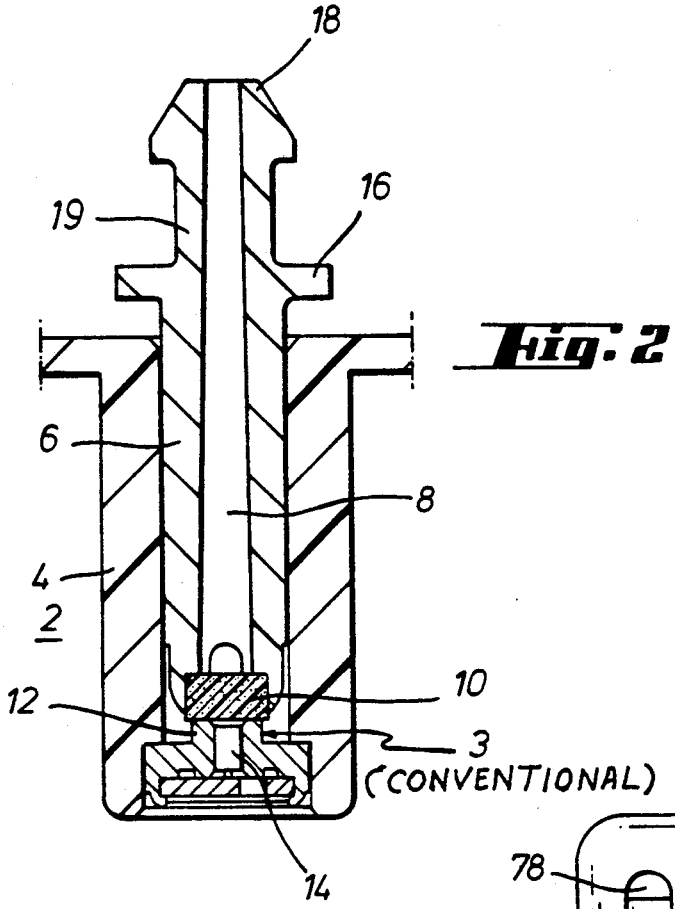
FIG. 2 is a longitudinal cross section, on a larger scale, of the exhaust chimney and the conventional flow valve from the liquefied gas reservoir.
Figure 3:
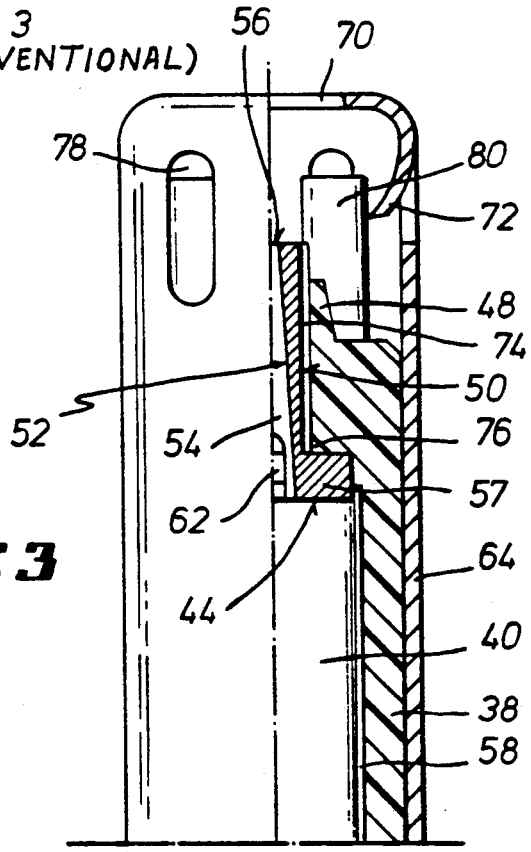
FIG. 3 is a plan view, partly in section and on a larger scale, of the end of the lighter removed from the reservoir.

The liquefied gas lighter of the invention comprises a gas reservoir 2 in which there is a conventional valve 3 shown in detail in FIG. 2.

This shows space surrounded by a wall 4 penetrating in the reservoir 2. This space contains an exhaust chimney 6, which may slide within the space and which defines an inner passage 8. At the bottom there is a stopper member 10 of elastomeric material, fixedly attached to the chimney 6. The member 10 is engageable with the stopper spout 12 and in such position it prevents the controlled flow of gas along the inner passage 8, whereas if the stopper member 10 is separated from the stopper spout 12, the gas is allowed to flow from the reservoir 2 through the orifice 14. For actuating the chimney 6 and thereby opening or closing the valve 3, there is preferably an annular flange 16 adjacent the end 18 of the exhaust chimney 6, defining an end portion 19 of said chimney.

The lighter also comprises actuating means 20 comprising fundamentally a push button 22 which is accessible to and may be actuated by the user through the actuating surface 23. Fixedly attached to said push button 22 and forming part of the actuating means 20 there is a straight tubular member 24 to be referred to hereinafter in further detail. In the embodiment described and illustrated, the actuating means is made from electrically conductive material and may be made from moulded plastics coated with a metallized layer which may cover all the surfaces thereof, both inside or outside. It is also contemplated that it be a conductive polymer such as the one marketed by HOECHST under the tradename of HOSTAFORM 9021 LS. In a known way, the actuating means 20 may move between a first position in which the valve is closed and the second position in which it is open. In the lighter of the invention, the movement occurs as an axial movement of the straight tubular member 24. A resilient means 26 urges the actuating means 20 to said first position.

A first end portion 28 of the straight tubular member 24 surrounds the end portion 19 of the exhaust chimney 6 and said first end 28 engages the annular flange 16, alternately closing or opening the valve 3. Thereby, the interior of the straight tubular member 24 constitutes a first portion for the flow of gas exiting through the exhaust chimney. To ensure a tight seal between the chimney 6 and the tubular member 24, there is provided a bushing 30 of resilient material, of which a first end region 32 is sealingly engaged in the gas reservoir 2, while a second end region 34 is provided with a lip 35 which externally engages the straight tubular member 24 and forms a gasket against which the straight tubular member 24 slides on being moved.

A second end portion 36 of the tubular member 24, obviously opposite to the first end portion 28, is provided with a open end 37 and is inserted snugly in a straight container tube 38, which contains therein an impact piezo-electric generator 40. This generator has a front end 42 engaging the port 37 of the tubular member 24 and the rear end 44 opposite to the front end 42 and, therefore, removed from the gas reservoir 2.

The straight tubular member 24 is generally coaxial with the container tube 38. The latter is provided with a front open end 46 adjacent the reservoir 2 in which the tubular member 24 is snugly inserted. This snug fit provides a seal between the tube 38 and the member 24, which seal is maintained during the movements of the member 24.

Opposite to the front open end 46 there is a rear open end 48 having an inner circular edge 50 which is preferably of smaller diameter than the interior or holow of the container tube 38. The container tube 38, further to the piezoelectric generator 40 partly contains a metal burner 52, while another part of the burner passes through the rear open end 48, in contact with the inner edge 50. The metal burner 52 is provided with an axial inner passage 54 having and end outlet 56 extending beyond the rear open end 48. The base 57 of the burner engages the rear end 44 of the generator 40.

The interior of the straight tubular member 24, the interior of the container tube 38 and the axial inner passage 54 of the burner 52 form a gas passage extending from the exhaust chimney 6. To this end, there are first communication means for the gas flow extending between the front and rear ends 42 and 44 of the container tube 38.

In one embodiment, not shown, the first gas flow communication means is formed by one or more channels crossing through the piezo-electric generator 40. In this embodiment the channels place the hollow interior of the straight tubular member 24 in direct communication with the axial inner passage 54 of the burner 52.

In a further embodiment, the first communication means is formed by one or more axial interstices 58 between the container tube 38 and the piezo-electric generator 40. To complete the gas flow route, there is provided second gas flow communication means placing the interior of the tubular member 24 in communication with the axial interstices 58. Preferably the second means comprises slots 60 in the open end 37 of the tubular member 24 overcoming the obstacle formed by the engagement of the open end 37 with the front end 42 of the piezo-electric generator 40.

Furthermore, there are third gas flow communication means to place the interstices 58 and the axial inner passage 54 of the metal burner 52 in communication. Preferaby said third means comprises ports 62 formed in the burner 52 transversely from the burner base 57.

The ligher is also provided with an external metal shield 64 partly encasing the container tube 38, as well as an extension 66 of the covers 68 between which the reservoir 2 and other components of the lighter are housed. The shield 64 extends beyond the end outlet 56 of the burner and is provided with an end orifice 70. Furthermore, it engages .the pushbutton 22 at least when the latter is in the second open position thereof and this sliding contact is sufficient to provide electrical conductivity between the pushbutton 22 and the shield 64. Adjacent the end outlet 56 of the burner 52, the shield 64 is provided with a pointed tab 72 which, as described hereinafter, forms an electrode.

When the user actuates the pushbutton 22, on the one hand he causes the first end portion 28 of the tubular member 24 to release the pressure on the flange 10 of the exhaust chimney 6, whereby the flow valve 3 opens and the gas starts to flow from the reservoir 2. Furthermore, the open end 37 of the second end portion 36 presses the front end 42 of the generator 40, compressing it and loading it to its discharge stroke. At this time there appears a high potential difference between the electrodes, which are precisely the front and rear end 42 and 44. As stated above, the rear end 44 is in direct contact with the metal burner 52, while the other electrode, i.e. the front end 42 engages the open end 37 of the straight tubular member 34. Since this is electrically conductive, the current reaches the pushbutton 22 and in view of the sliding contact, also reaches the external metal shield 64. As said above, the shield 64 is provided with the pointed tab 72, the tip of which is at the level of the end outlet 56 of the burner, preferably at a distance of 3 mm therefrom. In this way the means has been prepared for a discharge of such a high voltage as to ionize the air and form a spark initiating a combustion reaction of the released gas flow, between the two extreme ends of the electrical circuit (burner 52 and tab 72), on creating a potential difference in the piezo-electric generator 40 after actuation of the pushbutton 22. This flame is formed downstream of the burner 52 and exits to the outside through the orifice 70 of the external metal shield 64.

The axial arrangement of the straight tubular member 24, the exhaust chimney 6 and the generator 40 housed in the container tube and the simultaneous actuation thereof, guarantee the consecutive occurrence of the setting up of the gas flow and the discharge, which generally ensures that the combustible gas is already in the end outlet of the burner 52 when the electrical discharge occurs, which aspect is to be particularly controlled since the duration of the discharge is extremely short. Furthermore, since the whole path to be followed by the gas flow, i.e. the inner passage 8 of the exhaust chimney 6, the conduit formed by the straight tubular member 24, the axial interstice 58 between the piezo-electric generator 40 and the container tube 38 and the axial inner passage 54 of the burner 52 has only one opening to the atmosphere which is through said axial inner passage 54 of the burner 52, since said passage is of reduced cross section, gas bleeds out of the gas flow path very slowly so the gas flow path is generally endowed with a sufficient quantity of gas to produce an ignition in response to a spark, even after an extended period of time without actuating the mechanism. This advantage is to be appreciated if it is wanted that the lighter should function at the first squeeze after a long time at rest.

As may be appreciated in the Figures, the gas flowing around the piezo-electric generator 40 through the interstice 58 flows into the axial inner passage 54 through the ports 62 towards the end outlet 56 of the burner 52. However, so that the low energy (a few tenths of mJ) released by the electrical discharge may ignite the gaseous fuel reliably, it is necessary for the arc or spark formed to cross through an area where the gaseous fuel is combined with the air in a ratio within the upper and lower limits of the explosion range, i.e. in the case of isobutane, for example, the fuel-air ratio is from 2 to 8%.

To this end the burner 52 is provided with a plurality of external axial slots 74 defining with the rear open end 48 of the container tube 38, in which the burner 52 is a snug fit, a plurality of axial conduits which are substantially narrow with respect to the cross section of the axial inner passage 54. The gas flow is directed to the axial slots 74 by way of a tapering annular space 76 formed between the burner 52 and the container tube 58 in communication with the ports 62 and distributing part of the total gas flow to the outer slots 74. This narrow conduits may also be found by slots in the edge 50 of the rear open end 48 of the container tube. Thus, there are provided around the burner 52 and the main gas flow exiting from the end outlet 56 thereof a plurality of small gas flows, which may called secondary flows having a small flow rate and speed, which conditions are suitable for this secondary flow to combine with the air around the burner in the desired proportion and reach the discharge area in an explosive ratio to act as primer and booster of the low energy released by the arc, communicating it to the main flow. WHen the lighter is stably ignited, the combustion draught entrains the secondary flow and complete combustion occurs outside the protective metal tube 64, beyond the orifice 70.

To provide the air required for stable flame, the outer metal shield 64 is provided with several longitudinal windows 78 adjacent the burner 52. To avoid the posibility of an external current of air blowing away the weak secondary flows emerging from the axial slots 74, hindering priming and boosting of the ignition, on flowing in through the windows 78, the container tube 38 has been moulded with a series of tabs 80 of the same number as the longitudinal windows 78 and located in front of the latter, so that any external current of air is obliged to flow in circular fashion and its harmful effect is weakened.

A further additional advantage of the axial disposition of all the moving components is that when the straight tubular member 24 comprises the piezo-electric generator 40, on being actuated, within the container tube 38, which acts as a jacket, there is produced a piston effect whereby, on actuation, the secondary flow through the axial slots 74 is faster and the air-gas mixture is more intimate.

With an arrangement and conformation as described in the foregoing paragraphs, which is only a preferred embodiment, there is obtained a kitchen lighter having less components and simpler assembly than those previously known. Some of the advantages achieved are listed below:

The specific electrical conductors may be dispensed with, with no insulated leads or die-stamped metal plates being required.

The supply tubes from the exhaust chimney to the burner may be dispensed with, greatly simplifying assembly.

Since it is not necessary to plug in tubes or look after contact of the electrical conductors, assembly is much simpler and automatable.

What I claim is:

1. A liquid gas kitchen lighter comprising a gas fluid reservoir having a gas exhaust chimney which is in contact with a gas flow valve, said exhaust chimney extending partially within a straight tubular member said tubular member extending axially from said chimney and terminating coaxially with and abutting a piezo-electric generator having a front end and a rear end, said generator being disposed within a straight container tube which at one end extends coaxially over said straight tubular member and at another end terminates abutting a burner which defines an internal axial passage, wherein the reservoir, exhaust chimney, straight tubular member, generator, straight container tube and burner are arranged to define a straight gas flow path from said reservoir to said burner, said lighter being actuatable by an actuating means movable between an open and a closed position with a resilient means urging the said actuating means to said closed position, said means having an accessible pushbutton and being secured to said straight tubular member, said tubular member being operably attached to said gas flow valve and said generator so that when said actuating means is operated said lighter will release gas and activate said generator to produce a flame.

2. The lighter of claim 1, wherein said straight tubular member is provided with a first end portion surrounding an end portion of said exhaust chimney and second end portion having a port engaging the front end of the piezo-electric generator.

3. The lighter of claim 2, wherein the lighter is provided with a bushing of resilient material having a first end region sealingly engaging the gas reservoir and a second end region, opposite to said first end region, having a lip internally engaging the said straight tubular member, forming a seal relative to which the said straight tubular member slides when moving.

4. The lighter of claim 2, wherein there are first gas flow communication means, contained in the container tube extending between said front and rear ends of said piezo-electric generator.

5. The lighter of claim 4, wherein said first communication means comprises at least one axial interstice between the piezo-electric generator and the container tube.

6. The lighter of claim 5, wherein there are : a) second gas flow communication means placing the interior of the tubular member in communication with said interstices; and b) third gas flow communication means placing said interstices in communication with the inner passage of said burner.

7. The lighter of claim 6, wherein said second communication means comprises slots formed in said open end of the second end portion of said straight tubular member.

8. The lighter of claim 6, wherein said third communication means comprises ports of the burner extending between said interstices and said inner passage of the burner.

9. The lighter of claim 1, wherein said container tube is provided with: a) a front open end adjacent the reservoir by which said straight tubular member is snugly and slidingly engaged; and b) a rear open end, opposite to the front open end, and having an inner circular edge, said rear open end having therein said burner in contact with said edge.

10. The lighter of claim 9, wherein between said inner circular edge of the rear open end of the container tube and the outer surface of said burner there are narrow gas flow conduits, with the sum of the flow sections of said narrow conduits being substantially smaller than the flow section of the axial inner passage of the burner.

11. The lighter of claim 10, wherein said narrow conduits are axial slots external to the burner.

12. The lighter of claim 1, wherein said actuating means is made from electrically conductive material.

13. The lighter of claim 12, wherein said material is moulded plastic covered by a metallized coating.

14. The lighter of claim 12, wherein said actuating means is formed by a plastic moulded from a conductive polymer.

15. The lighter of claim 12, wherein said external protective shield makes contact with said pushbutton at least when the latter is in said second position; surrounds said container tube and forms an electrode having a pointed tab adjacent said end outlet of the burner.

16. The lighter of claim 12, wherein said straight tubular member is electrically connected to said front end of the piezo-electric generator and said burner is electrically connected with said rear end of the piezo-electric generator.

* * * * *

UNITED STATES PATENT AND TRADEMARK OFFICE

CERTIFICATE OF CORRECTION

PATENT NO. : 5,154,601
DATED : October 13, 1992
INVENTOR(S) : Francisco X. L. Capilla It is certified that error appears in the above-indentified patent and that said Letters Patent is hereby corrected as shown below:

On the Title page, item [30], "Iceland" should read as --Spain--

Signed and Sealed this

Fifteenth Day of March, 1994

*Attest:*

Bruce Lehman

BRUCE LEHMAN

*Attesting Officer*

*Commissioner of Patents and Trademarks*